US005164697A

United States Patent [19]

Kramer

[11] Patent Number: 5,164,697

[45] Date of Patent: Nov. 17, 1992

[54] INPUT KEYBOARD FOR AN ELECTRONIC APPLIANCE IN ENTERTAINMENT ELECTRONICS

[75] Inventor: Richard Kramer, Eisingen, Fed. Rep. of Germany

[73] Assignee: Nokia Unterhaltangselektronik GmbH, Fed. Rep. of Germany

[21] Appl. No.: 679,609

[22] Filed: Apr. 3, 1991

[30] Foreign Application Priority Data

Apr. 11, 1990 [DE] Fed. Rep. of Germany ..... 4011636

[51] Int. Cl.[5] ..... H01C 10/10

[52] U.S. Cl. ..... 338/69; 338/114; 84/423 B

[58] Field of Search ..... 338/69, 99, 114; 84/423 B

[56] References Cited

U.S. PATENT DOCUMENTS

| | | | |
|---|---|---|---|
| 4,296,406 | 10/1981 | Pearson | 340/166 |
| 4,419,653 | 12/1983 | Waigand . | |
| 4,596,912 | 6/1986 | Hattori . | |
| 4,847,586 | 7/1989 | Tanaga et al. | 338/114 |

FOREIGN PATENT DOCUMENTS

| | | |
|---|---|---|
| 50231 | 4/1982 | European Pat. Off. . |
| 2304736 | 8/1974 | Fed. Rep. of Germany . |
| 2343979 | 4/1975 | Fed. Rep. of Germany . |
| 2343980 | 4/1975 | Fed. Rep. of Germany . |
| 3123438 | 5/1983 | Fed. Rep. of Germany . |
| 3505418 | 7/1985 | Fed. Rep. of Germany . |
| 3241159 | 10/1986 | Fed. Rep. of Germany . |
| 3543890 | 6/1987 | Fed. Rep. of Germany . |
| 8403172 | 8/1984 | PCT Int'l Appl. . |
| 1431649 | 4/1976 | United Kingdom . |
| 1447157 | 4/1976 | United Kingdom . |

OTHER PUBLICATIONS

Radio Mentor Elektronik, No. 11, (1980), pp. 311-315.
Funkschau, 1985, p. 12.

*Primary Examiner*—Marvin M. Lateef
*Attorney, Agent, or Firm*—Ware, Fressola, Van Der Sluys & Adolphson

[57] ABSTRACT

An input keyboard (1) contains a switching device (3) for pushbuttons (22) wherein the contact linings (11.1, 11.2) on a printed circuit board (10) are bridged by a countercontact (16) operated by the pushbutton (22). The countercontact (16) consists of a carbonized plastic foil (14) and an electrically conducting layer (17) on the side facing away from the contact linings. By virtue of this arrangement there comes into being a bridging resistance between the bridged conductor strips (12.1, 12.2) that depends on the operating pressure (P) applied to the pushbutton, this resistance being then used to cause a control circuit arrangement (6) to generate a control command (Bf) for setting a particular function and an adjustment command (Bw) for setting a particular value or adjustment rate.

20 Claims, 1 Drawing Sheet

INPUT KEYBOARD FOR AN ELECTRONIC APPLIANCE IN ENTERTAINMENT ELECTRONICS

BACKGROUND OF THE INVENTION

1. Field of the Invention

The present invention concerns an input keyboard for an electronic appliance in entertainment electronics.

2. Description of the Prior Art

It is becoming ever more common for the appliances of entertainment electronics to comprise input keyboards for either local control in the appliance itself or for remote control in a remote control device, where the base of the said keyboard is constituted by a circuit board with printed switch contacts. This design of an input keyboard facilitates the manufacture of input keyboards of this type and lowers their production costs. An input keyboard of this type for a remote control transmitter is known, for example, from the German periodical rme, 1980, No. 11, pages 311 to 315. This known remote control transmitter contains contacts for several pushbutton switches of the remote control transmitter, the said contacts being situated on a printed circuit board in copper-carbon technique, and a contact rubber mat laid between the circuit board and the pushbuttons, which are guided by openings in the cover plate of the remote control transmitter. At the positions corresponding to the various pushbuttons of the remote control transmitter, rubber domes are formed in the contact mat to act as spring elements. These rubber domes produce a snap effect upon depression of the pushbutton and contain a carbon contact that is vulcanized into the side that faces the contacts on the circuit board.

In many cases such input keyboards have to be used not only for choosing or setting functions, but also for changing values. It is becoming more and more common for such value adjustments to be brought about by electronic devices, for example by means of electronic selectors whose modulation rate can be set according to the position of the selector, or by means of trigger thresholds where the threshold value can be adjusted.

SUMMARY OF THE INVENTION

The present invention is therefore underlain by the problem of providing pushbutton switching devices in an input keyboard that can be used to produce not only a switching process but also an adjustment process and will not appreciably complicate the manufacturing process of such an input keyboard.

The present invention contemplates an input keyboard for an electronic applicance in entertainment electronics, said keyboard having pushbuttons guided at right angles to a keyboard cover plate and an insulating printed circuit board carrying, in positions correlated with the pushbuttons, contact linings that are to be electrically connected. Switching devices are situated between the pushbuttons and the insulating printed circuit board so that each of said switching devices is correlated with one of the pushbuttons and containes a countercontact that whenever the pushbutton correlated with the switching device is in its depressed position, will provide a large area of electrical connection between the correlated contact linings. The countercontact contains a carbonized plastic foil of high electrical resistance that bears against the insulating edge arranged between the printed circuit board and the plastic foil and surrounding the area of the contact linings correlated with the pushbutton. The plastic foil having a certain, though very small, electrical conductivity and a thickness that is very small as compared to the distance between the contact linings correlated with the appropriate pushbutton that are to be electrically connected. On the side of the carbonized carbon foil facing away from the contact linings there is arranged an electrically conducting layer having an electrical conductivity that is very great as compared with the electrical conductivity of the carbonized plastic foil. The contact linings correlated with a given pushbutton are connected to a control circuit arrangement that will convert the value of the bridging resistance of the switching device, said bridging resistance depending on the pressure that the depressed pushbutton exerts on the countercontact of that pushbutton, into a control command that determines both a control or adjustment function and a control or adjustment variable.

To all intents and purposes, an input keyboard in accordance with the present invention can be designed in just the same way as a traditional input keyboard that contains only switching functions. The carbonized plastic foil with the additional conducting layer that has to be added occupies a height of no more than a few tens of micrometers and is of no relevance at all as compared with the overall height of such input keyboards, even though this height is normally only of the order of a few millimeters.

It is the merit of the inventor to have realized that the transition resistance at the bearing surfaces of the contact elements remains a practically linear function of the pressure over a wide range of far more than two powers of ten and that this resistance pattern at right angles to the carbonized contact foil can be monitored through the contact foil and conveyed for evaluation to a control circuit arrangement connected to the pushbutton contact, and this without the lateral extension of the carbonized plastic foil exerting any substantial influence on the said pattern.

It is perfectly true that European Patent Application 0050231 A2 discloses a switching device that essentially contains two layers made of an elastomer substance interspersed with electrically conducting particles and that these layers are characterized by a pressure-dependent volume resistance. For the purposes of an input keyboard however, such an arrangement occupies far too much space in the vertical direction (height). Moreover, investigations have shown that the ageing stabilities of these substances are altogether inadequate both with respect to the environmental influences acting on them and with respect to the pressure reversals that have to be resisted. In this respect, indeed, the carbonized plastic foil used in the input keyboard in accordance with the present invention yields results that are several times superior.

The present invention provides some advantageous embodiments. For example, it is advantageous to arrange a spring element between the bottom end of a pushbutton and the countercontact of that pushbutton and thus to ensure that, when the pushbutton is operated, its pressure will become uniformly distributed over the carbonized plastic foil acting as countercontact. When the said spring element is of a certain thickness, it will act as a displacement-sensitive pressure transducer that will convey to the user of the input keyboard the feeling that, displacing the pushbutton through a certain, albit very small distance, he can sense the adjustment rate or parameter magnitude to be set by means of the pushbutton in a manner to which he is psychologically accustomed.

The fact that the conducting layers are executed as graphite layers has the advantageous effect that such graphite layers are not very sensitive to environmental influences, so that the contact properties of the pushbutton contact system change, at the very most, in an insignificant manner over a long period of time and a large number of depressions of the pushbutton.

A particularly advantageous manner of providing a bearing for the carbonized plastic foil with respect to the contact surfaces that are to be bridged is to assign this function to the edge of a cutout in a thin insulation plate arranged between the circuit board and the plastic foil, the cutouts in the said insulating plate being so arranged as to bare the various contact surfaces for bridging. Given its minute thickness, such an insulating plate, once again, will not call for additional space between the printed circuit board and the keyboard cover plate. It also ensures that the vertical movement of the carbonized plastic foil can be kept very small.

DESCRIPTION OF THE DRAWINGS

This invention and its advantages will now be described in greater detail by reference to advantageous embodiments and illustrated by the attached drawing, where.

DETAILED DESCRIPTION OF THE INVENTION

Figure 1:
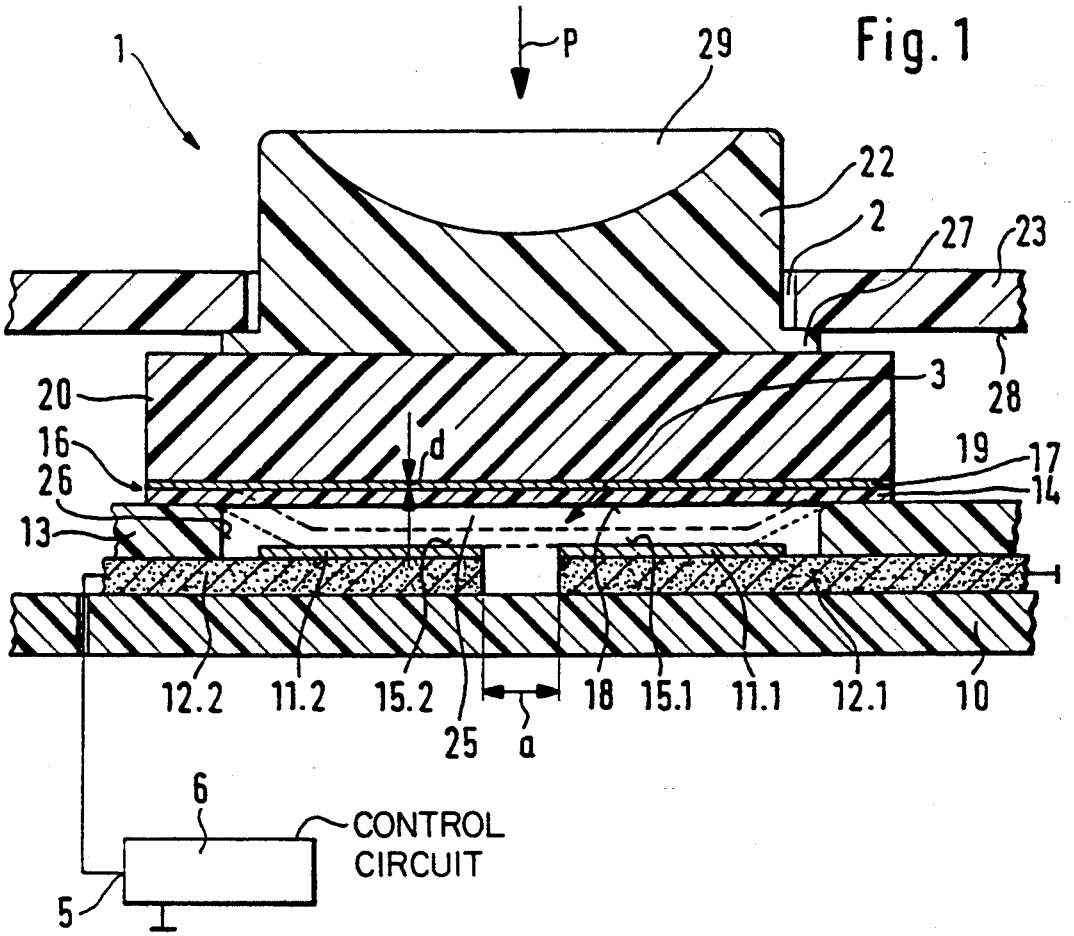
FIG. 1 shows a schematic section through a part or excerpt of an input keyboard, the contact arrangement illustrated therein being electrically connected to a control circuit arrangement.

FIG. 1 represents an excerpt of an input keyboard 1 and shows a section through a pushbutton 22 that passes through an opening 2 in the cover plate 23 of an input keyboard and is provided with a view to making possible a pressure-sensitive connection between two contact linings 11. and 11.2 of a switching device 3. The bottom end 27 of the pushbutton 22, which projects laterally beyond the body of the said pushbutton 22 and—in the rest position of the pushbutton—bears with its upper side against the underside 28 of the keyboard cover plate 23, carries affixed to its underside a plate-shaped spring element 20 made of a plastic material with [ . . . good . . . ] elastic springing back against compression. The underside 19 of the spring element 20 is covered with a conducting layer 17 of high electric conductivity and this layer, in its turn, is covered by a carbonized plastic foil 14. The carbonized plastic foil 14 and the conducting layer 17 on its upper side jointly constitute the countercontact 16 of the switching device 3 operated by means of the pushbutton 22. The contacts of the switching device 3 that are to be connected by means of the countercontact 16 are applied as contact linings 11.1 and 11.2 to the conductor strips 12.1 and 12.2 of a printed circuit board 10 of the input keyboard, the said conductor strips being widened into appropriate surfaces in the area of the contact linings. In the embodiment here considered these contact linings are graphite linings. The embodiment here considered also comprises a thin insulating plate 13 that, resting on the conductor strips, acts as a spacer between the countercontact 16 of the pushbutton 22 and the contact linings 11.1 and 11.2 of the conductor strips 12.1 and 12.2 of the printed circuit board 10. In the area of the contact surfaces 11.1 and 11.2 the thin insulating plate 13 contains a cutout 31 and the edge 32 of the said cutout 31 to all intents and purposes provides the bearing for the countercontact 16 of the switching device 3.

When the pushbutton 22 is operated by applying to its operating face 29 a force P acting in the direction of the arrow shown in FIG. 1, the spring element 20 will be deformed in such a manner that the contact surface 18 of the countercontact 16, though resting on the edge 26 of the cutout 25 in the thin insulating plate 13, will come to bear against the contact surfaces 15.1 and 15.2 of the contact linings 11.1 and 11.2. This switching condition is indicated in FIG. 1 by means of the broken lines in the area of the switching arrangement. The contact resistance Rk(P) between the contact surface 18 of the countercontact 16 and the contact surfaces 15.1 and 15.2 in this switching condition depends on the operating pressure applied to the pushbutton 22.

Figure 2:
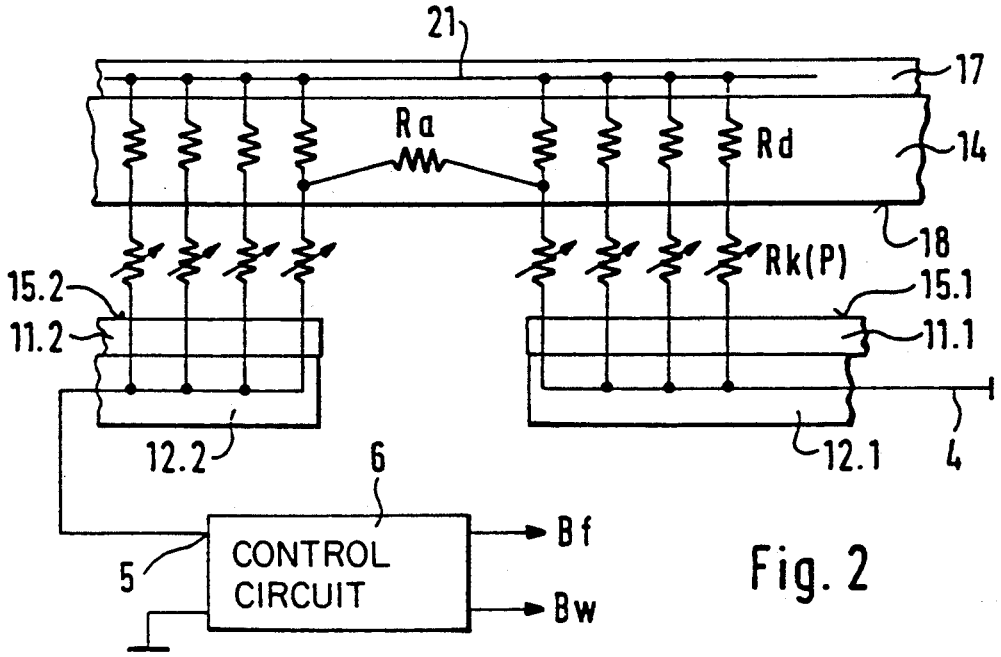
FIG. 2 shows a circuit diagram corresponding to the contact arrangement shown in FIG. 1.

The bridging resistance between the conductors 12.1 and 12.2 to be connected by the switching device will thus be made up of the contact resistances Rk(P) between the contact surfaces 15 and 18 and the resistance Rd of the countercontact 16, and the mode of action of this bridging resistance will now be discussed in greater detail by reference to the circuit diagram shown in FIG. 2. The thickness d of the carbonized plastic foil 14 of the countercontact 16 is chosen in such a way that the electrical resistance Rd between the two surfaces of the carbonized plastic foil—notwithstanding the small electrical conductivity of the foil—remains relatively small as compared with the total bridging resistance and also as compared with the effective electrical resistance Ra in the longitudinal direction of the foil. The thickness d of the foil is therefore substantially smaller than the distance a between the two contact linings 11.1 and 11.2 that are to be connected to each other. In the embodiment here illustrated the foil thickness is of the order of 20 micrometers. Given these dimensional relationships and the fact that the conducting layer 17 on the side of the carbonized plastic foil facing away from the contacts has an electrical conductivity that is high as compared with the electrical conductivity of the carbonized plastic foil itself, electric current conduction in the carbonized plastic foil 14 will take place essentially in the direction at right angles to the foil, as is schematically indicated in FIG. 2 by means of the resistances Rd within the bar 14 that there represents the carbonized plastic foil.

The longitudinal resistance Ra indicated therein represents the longitudinal resistance of the foil between the two conductor strips 11.1 and 11.2 bridged by the countercontact 16 and is a very large multiple of the contact resistances Rd through the carbonized plastic foil, so that the current flowing within the carbonized plastic foil in a direction parallel to its surfaces is quite insignificant. To all intents and purposes, therefore, current conduction in this direction takes place only outside the carbonizied plastic foil, namely in the electrically conducting layer 17, as is schematically indicated by the electric lead 21 within this layer. The pressure-dependent contact resistance between the contact surface 18 of the carbonized plastic foil and the contact surfaces 15.1 and 15.2 of the contact linings 11.1 and 11.2 of the conductor strips 12.1 and 12.2 of the printed circuit board 10 is schematically indicated in FIG. 2 by means of the resistances Rk(P) controlled by a pressure P. These resistances diminish linearly as the contact pressure increases, the linear relationship being preserved over a range of two to three powers of ten. This contact pressure is constituted by the operating pressure P acting on the pushbutton 22, since the spring element 20 transfers this pressure to the contact surface 18 of the carbonized plastic foil 14.

In the embodiment here illustrated the electric conductor 12.1 of the printed circuit 10 is a reference potential conductor, a feature that in FIG. 1 is indicated by the reference potential conductor 4. The other contact lining 11.2 is connected to the control input 5 of a control circuit arrangement 6 via the conductor strip 12.2. When the pushbutton 22 is depressed, the control circuit arrangement 6 reacts to the bridging resistance applied to its control input 5 by producing a function command Bf to set a certain function of an electrical appliance that is being remotely controlled by means of the input keyboard, as well as a command Bw that depends on the value of the bridging resistance generated by the depressed pushbutton 22, where the said command Bw sets the value associated with the triggered function or the value of an adjustment rate.

In the embodiment illustrated by FIG. 1 the thickness and the compliance (elasticity) of the spring element 20 are so chosen as to obtain not only a more or less uniform pressure over the entire bearing area between the contact surface 18 of the countercontact 16 and the contact linings 11.1 and 11.2 of the switching devices 3, but also to ensure that the spring element 20 will act as a sensitive pressure-displacement transducer for the user of the input keyboard and, consequently, convey to him the feeling of increasing pressure as the operational displacement of the pushbutton becomes greater. In another advantageous embodiment of such an input keyboard that is not illustrated in the drawing attached hereto, the spring element 20 is attached to the ceiling surface of a rubber dome of a contact mat that is arranged between the bottom 27 of a pushbutton 22 and the said spring element 20. Like the thin insulating plate in the previous embodiment, the rubber dome bears against the printed circuit board 10 and, upon the depression of the appropriate pushbutton 22, will first actuate a switching process with a snap effect and subsequently permit pressure-dependent adjustment of a function variable. In this way it becomes possible to combine switching devices with and without an additional pressure-dependent adjustment function in one and the same contact mat.

In yet another embodiment of such an input keyboard the carbonized plastic foil extends without solution of continuity over the entire pushbutton area of the input keyboard. In that case the electrically conducting layer of high conductivity will be applied either to the underside of the spring element of each individual pushbutton or to the side of the carbonized plastic foil that faces the pushbuttons 22 in the area of the switching device.

The use of graphite linings as contact lining opposite the surfaces of the carbonized plastic foil has been found to be particularly advantageous, because a graphite lining, quite independently of environmental influences or the effects of repeated depression of the pushbutton, will for a long time generate substantially reproducible contact resistances obeying a linear pressure-resistance relationship over a wide range of resistances.

I claim:

1. An input keyboard for an electronic appliance in entertainment electronics with pushbuttons guided at right angles to the keyboard cover plate (23) and an insulating printed circuit board carrying, in positions correlated with the pushbuttons, contact linings that are to be electrically connected, and with switching devices situated between the pushbuttons and the insulating printed circuit board, where each of the switching devices is correlated with one of the pushbuttons and contains a countercontact that, whenever the pushbutton correlated with the switching device is in its depressed position, will provide a large area of electrical connection between the correlated contact linings, wherein the countercontact (16) contains a carbonized plastic foil (14) of high electrical resistance that bears against an insulating edge (26) arranged between the printed circuit board (10) and the plastic foil and surrounding the area of the contact linings (11.1, 11.2) correlated with the pushbutton (22), the plastic foil having a certain, though very small electrical conductivity and a thickness (d) that is very small as compared with the distance (a) between the contact linings correlated with the appropriate pushbutton that are to be electrically connected, on the side of the carbonized carbon foil facing away from the contact linings there is arranged an electrically conducting layer (17) having an electrical conductivity that is very great as compared with the electrical conductivity of the carbonized plastic foil, and the contact linings (11.1, 11.2) correlated with a given pushbutton are connected to a control circuit arrangement (6) for converting bridging resistance (Rk) of the switching device (3) into a control command (Bf, Bw) that determines both a control or adjustment function and a control or adjustment variable, the bridging resistance depending on the pressure (P) that the depressed pushbutton (22) exerts on the countercontact (16) of that pushbutton.

2. An input keyboard in accordance with claim 1, wherein a spring element (20) is arranged between the bottom (27) of a pushbutton (22) and the countercontact (16) of that pushbutton to ensure a uniform pressure distribution over the contact surface (18) of the countercontact.

3. An input keyboard in accordance with claim 2, wherein the spring element (20) is made of a plastic material having an elastic springing back characteristic against compression.

4. An input keyboard in accordance with claim 1 wherein the spring element (20) correlated with a pushbutton (22) is fixed to the bottom (27) of the pushbutton to constitute a component of the said pushbutton.

5. An input keyboard in accordance with claim 4, wherein the electrically conducting layer (17) is applied as a terminal layer to the bottom (27) of the pushbutton (22).

6. An input keyboard in accordance with claim 1, wherein the electrically conducting layer (17) is applied to the side of the carbonized plastic foil (14) facing away from the contact linings (11.1, 11.2) of a switching device (3) at least in the area of the said contact linings.

7. An input keyboard in accordance with claim 1, wherein the electrically conducting layer (17) is a graphite layer.

8. An input keyboard in accordance with claim 1, characterized in that the contact linings (11.1, 11.2) correlated with a pushbutton (22) consist of a graphite layer that is applied to the appropriate conductor surfaces (12.1, 12.2) of the printed circuit board (10).

9. An input keyboard in accordance with claim 1, characterized in that the insulating edge that provides a bearing for the carbonized plastic foil (14) is the edge (26) of a cutout (25) in a thin insulating plate (13) arranged between the printed circuit board (10) and the carbonized plastic foil, the said cutout surrounding the area of the contact linings (11.1, 11.2) correlated with the pushbutton (22).

10. An input keyboard in accordance with claim 2, wherein the spring element (20) correlated with a pushbutton (22) is fixed to the bottom (27) of the pushbutton to constitute a component of the said pushbutton.

11. An input keyboard in accordance with claim 3, wherein the spring element (20) correlated with a pushbutton (22) is fixed to the bottom (27) of the pushbutton to constitute a component of the said pushbutton.

12. An input keyboard in accordance with claim 10, wherein the electrically conducting layer (17) is applied as a terminal layer to the bottom (27) of the pushbutton (22).

13. An input keyboard in accordance with claim 11, wherein the electrically conducting layer (17) is applied as a terminal layer to the bottom (27) of the pushbutton (22).

14. An input keyboard in accordance with claim 2, wherein the electrically conducting layer (17) is applied to the side of the carbonized plastic foil (14) facing away from the contact linings (11.1, 11.2) of a switching device (3) at least in the area of the said contact linings.

15. An input keyboard in accordance with claim 3, wherein the electrically conducting layer (17) is applied to the side of the carbonized plastic foil (14) facing away from the contact linings (11.1, 11.2) of a switching device (3) at least in the area of the said contact linings.

16. An input keyboard in accordance with claim 2, wherein the electrically conducting layer (17) is a graphite layer.

17. An input keyboard in accordance with claim 3, wherein the electrically conducting layer (17) is a graphite layer.

18. An input keyboard in accordance with claim 2, wherein the contact linings (11.1, 11.2) correlated with a pushbutton (22) consist of a graphite layer that is applied to the appropriate conductor surfaces (12.1, 12.2) of the printed circuit board (10).

19. An input keyboard in accordance with claim 3, wherein the contact linings (11.1, 11.2) correlated with a pushbutton (22) consist of a graphite layer that is applied to the appropriate conductor surfaces (12.1, 12.2) of the printed circuit board (10).

20. An input keyboard in accordance with claim 2, wherein the insulating edge that provides a bearing for the carbonized plastic foil (14) is the edge (26) of a cutout (25) in a thin insulating plate (13) arranged between the printed circuit board (10) and the carbonized plastic foil, the said cutout surrounding the area of the contact linings (11.1, 11.2) correlated with the pushbutton (22).

* * * * *

UNITED STATES PATENT AND TRADEMARK OFFICE

CERTIFICATE OF CORRECTION

PATENT NO. : 5,164,697

DATED : November 17, 1992

INVENTOR(S) : Richard Kramer

It is certified that error appears in the above-identified patent and that said Letters Patent is hereby corrected as shown below:

At column 6, line 56, after "claim 1" please insert a comma.

At column 7, line 5, "characterized in that" should be --wherein--; and
at line 6, "consist" should be --is comprised--.

At column 7, line 10, "characterized in that" should be --wherein--; and
at line 14, please delete "said".

Signed and Sealed this

Ninth Day of November, 1993

*Attest:*

*Attesting Officer*

BRUCE LEHMAN

*Commissioner of Patents and Trademarks*